US005782612A

United States Patent [19]

Margardt

[11] Patent Number: 5,782,612

[45] Date of Patent: Jul. 21, 1998

[54] HYDRAULIC GAS COMPRESSOR

[75] Inventor: Manfred Margardt, Heusweiler-Holz, Germany

[73] Assignee: Hydac Technology GmbH, Sulzbach/Saar, Germany

[21] Appl. No.: 549,734

[22] PCT Filed: Jul. 2, 1994

[86] PCT No.: PCT/EP94/02174

§ 371 Date: Nov. 27, 1995

§ 102(e) Date: Nov. 27, 1995

[87] PCT Pub. No.: WO95/06204

PCT Pub. Date: Mar. 2, 1995

[30] Foreign Application Priority Data

Aug. 23, 1993 [DE] Germany ..... 43 28 264.4

[51] Int. Cl.[6] ..... F04B 25/00; F04B 35/02

[52] U.S. Cl. ..... 417/266; 417/400

[58] Field of Search ..... 417/266, 398, 417/399, 400, 63

[56] References Cited

U.S. PATENT DOCUMENTS

| | | | |
|---|---|---|---|
| Re. 13,645 | 11/1913 | Stone | 417/266 |
| 4,111,609 | 9/1978 | Braun | 417/243 |
| 4,334,833 | 6/1982 | Gozzi | 417/266 |
| 4,345,880 | 8/1982 | Zanarini | 417/264 |
| 4,390,322 | 6/1983 | Budzich | 417/243 |
| 4,818,192 | 4/1989 | Korthaus | 417/400 |

FOREIGN PATENT DOCUMENTS

| | | |
|---|---|---|
| 1180597 | 6/1959 | France . |
| 2154066 | 5/1973 | France . |
| 1728317 | 3/1972 | Germany . |

*Primary Examiner*—Timothy Thorpe
*Assistant Examiner*—Peter G. Korytwyk
*Attorney, Agent, or Firm*—Roylance,Abrams,Berdo & Goodman, L.L.P.

[57] ABSTRACT

A gas compressor includes a housing, a separating element in the housing, and a piston guided for movement along the separating element by a drive mechanism between two dead center positions. Gas is compressed in a three-stage compression cycle by the piston in three separate gas chambers arranged in series in the housing. Pressure increases in the gas are easily feasible from very low to very high pressures, for instance from 5 to 400 bar, based on a relatively small installation. The gas compressor includes only a few wear parts for low manufacturing and maintenance costs and for fail-safe operation.

22 Claims, 7 Drawing Sheets

HYDRAULIC GAS COMPRESSOR

FIELD OF THE INVENTION

The present invention relates to a device to compress gas having a housing, a separating element mounted in the housing and a piston driven between two dead center positions.

BACKGROUND OF THE INVENTION

Hydraulic gas compressors are commercially available in a number of structural and operational embodiments. Essentially, two different structural embodiments are recognized, i.e., motor-powered and hydraulic/pneumatically driven compressors. Known gas compressors, also called compressors, require a large installation depending on the output required, and are of complex construction, producing the high assembly and maintenance outlay with the installation. The manufacturing, installation and maintenance costs are also high.

A known device for compression of gas is disclosed in European 0 193 498 A2. That device has three pistons connected with one another by a piston rod moved reciprocally within a housing/bushing by a hydraulic drive. Low pressure gas is compressed in the end area of the compressor to generate higher pressure gas. The known gas compressor alternatively performs a two-stage compression process on either side of the device. The separating element of the known device is formed by two housing walls, between which is movably arranged the central piston. Gas introduced at lower pressure is discharged alternately into the higher pressure compression chambers. Since the compression process has only two cycles, very high pressures cannot be attained.

In other known hydraulic gas compressor as in European 0 064 177 B1, the compressor requires two housings/bushings for compression units divided into at least three sections in the longitudinal direction to provide a minimum of three compression stages. A central area is divided into two chambers by a hydraulically operated piston. Additionally, two lateral gas compression areas are located in turn on the sides of the central area. The lateral areas have one piston each controlled by the hydraulically operated piston. Thus, the first compression unit includes both the first and the third compression stages and the second compression unit includes at least the second compression stage. For a three-stage gas compression cycle, required to achieve higher pressure, two housings and a total of five pistons are required, separated from one another at some spacing. In addition to their compression functions, the pistons are subjected to wear because of their seals, and thus, affect the reliability and safety of operation.

A gas compressor of this type is also disclosed in U.S. Pat. No. 4,345,880, and has a piston movable in stages by a drive arrangement. The piston facilitates a four-stage compression process. A hydraulically operated cylinder serves as a separating element along which the piston is guided to move in the housing/bushing. The working piston subdivides the hydraulic cylinder into two fluid chambers of variable volume. The volumes can be acted upon with fluid pressure to move the separating element alternately between two guides arranged separated from one another. The movable housing part of the separating element, configured as hydraulic cylinder, is connected securely with the separating element for the drive of the compressing piston. The hydraulic cylinder surrounds the separating element with a cylindrical sealed covering surface, while retaining some distance therefrom. Because of this configuration, the known gas compressor requires a large installation especially transversely. Because of the multiplicity of parts subjected to wear generated by the movable components, the operational security and safety is negatively affected and increased maintenance outlay is required.

SUMMARY OF THE INVENTION

Objects of the present invention are to provide a gas compressor which can produce high compression levels with low assembly and maintenance costs and with a safe operation.

The foregoing objects are basically obtained by a gas compressor, comprising a housing, a separating element stationarily mounted in the housing, and a piston mounted for movement guided along the separating element between first and second dead center positions. Drive means moves the piston along the separating element between the dead center positions. The drive means includes first and second fluid chambers of variable volume and first and second feed lines in the separating element coupled to the first and second fluid chambers, respectively. The first and second fluid chambers are separated by a seal and are bounded by the separating element and the piston. First, second and third separate gas chambers are within the housing about the piston. Conduit means connect the first, second and third gas chambers in series. Gas can be compressed in the chamber by the piston in a three-stage compression cycle.

In this manner, the three-stage compression cycle is provided by the piston which limits the three separate gas chambers arranged in series to accommodate the gas to be compressed. Both of the fluid chambers for the piston drive are limited by the piston and the separating element. The separating element is arranged stationary in the device. A pressure increase of the gas is possible from very low to very high pressures, with an extremely small installation. Such compressor can operate in a fail-safe manner, for instance, from 5 bar to 400 bar. Moreover, the stationary separating element provides the gas compressor of the present invention with few movable structural parts which are subjected to wear. The fewer movable structural parts enhances operational security and provides low manufacturing and maintenance costs.

The stationary separating element, which could also be regarded as "stator" of the device, allows direct fluid feed through its interior. The movement of the piston along the exterior periphery of the separating element, which one could also call a "free piston" or "flying piston", is not hindered in any way. Pressure oil/hydraulic oil is preferably used as fluid for driving the piston. However, a pneumatic drive could be adapted for special applications of the compressor to replace the hydraulic fluid drive.

The internal hydraulic control of the piston constitutes a double-acting cylinder. The stator undertakes the operation of the piston rod and the free/flying piston and the operation of the otherwise conventional stationary cylinder bushing/housing. This results in an "inverse" method of operation compared to cylinders, with the advantage that stator and free/flying pistons cannot be moved counter to one another. In contrast, only the free/flying piston can be moved in relation to the bushing/housing. Thus, the number of sealing points, which are highly problematic and required for guiding, is reduced. Further, no reaction forces are exerted on the stator. The tie bolts conventionally used in the cylinders are deleted. In turn, the free/flying piston in the compressor according to the present invention is the only required part in motion or under stress. Constructive measures to counter the otherwise conventionally occurring buckling stresses in the cylinders are deleted.

In one preferred embodiment of the compressor according to the present invention, for series connection of the separate gas chambers, each chamber has at least one inlet valve and one outlet valve. The relevant inlet valve of one separating chamber, following in series in the sequence formed by a link line, is connected with the outlet valve of the preceding separating chamber associated with it. In this manner, the three-stage compressing process can be operated with only six valves to improve the operational safety and reliability of the device.

Preferably, the inlet and outlet valves are designed as non-return valves operating in opposite directions and arranged in pairs for each compression stage. The valves can be Bernoulli valves, as described in the applicant's German Utility Model G 94 08 660.5. These dynamic reversing non-return valves are nearly insensitive to any reaction arising from high pressure lines, so that failshaft operation of the compressor is guaranteed. With these Bernoulli valves, the damage can be held to a minimum and no external arrangements, for example in the form of a camshaft, are required for control of the valves.

In one especially preferred embodiment of the compressor according to the present invention, the interior of the piston can be connected with the atmosphere through a pressure reducing channel. A pressure reducing chamber can be defined by the separating element and the piston with the housing, and can be held preferably at ambient pressure due to this pressure release into the atmosphere, the oil and gas sides of the compressor are reliably separated from one another. Possible oil leakages may be directly returned to the tank, with the existing gas pressure always being higher due to the pressure reduction performed.

In another particularly preferred embodiment of the compressor according to the present invention, the reciprocating piston includes a locking device with a pointer device indicating the position of the piston. The pointer device operates jointly with a change-over device, including limit switches, for reversing the movement of the piston when in one of its two dead center positions. This feature provides three functions—a locking device, a piston indicator for the piston and control of the piston in one unit at a central point of the compressor. This enhances its small size.

In a preferred embodiment of the compressor according to the present invention, the piston area of the piston operating in a specific gas chamber is smaller than the piston area in the gas chamber of the preceding pressure stage, with increasing pressure levels. The area ratios of the gas pressure chambers will, in addition to the fluid or oil pressure of the drive means, determine the maximum achievable final pressure of the compressor. The piston will simply remain static based on the selected stepped area ratios when the maximum final pressure is reached, eliminating with certainty the risk of any overload due to pressure or temperature.

In another preferred embodiment of the compressor according to the present invention, at least some of the conduit means or link lines are connected to heat exchangers. This ensures that heat, generated by the compressor during compression, can be dissipated. This heat dissipation improves operational safety of the device.

In another preferred embodiment of the compressor according to the present invention, a coolant can be fed through a pressure-reducing channel of the separating element into the interior of the piston and/or into a pressure-reducing cavity. This ensures that heat generated within the area of the piston during compression is easier to dissipate.

In a particularly preferred embodiment of the compressor according to the present invention, infinite gas discharge can be selected by control of the fluid volumes fed to the fluid chambers. The control is preferably by means of a pump and/or a pressure-reducing valve. The gas discharge of the compressor can be infinitely controlled notwithstanding the pressure level, by controlling the fed fluid volume and by setting the selectable displacement volume of the pump, and additionally or alternatively by setting a variable pressure-reducing valve. Another feature involves a demand-controlled extension of change-over time in both dead center positions of the piston, ensuring high efficiency even at low through-puts.

The compressor according to the present invention is preferably used for an internal gas pressure device, storing gas volumes compressed to high pressure device and storing gas volumes compressed to high pressure in an accumulator from which the gas volume required for a mold during injection molding can be selected. Internal gas pressure devices can run more economically by a device according to the present invention than by previously known compressors. By selecting the required highly-compressed gas volume specified for an injection molding process from the accumulator, smooth operation of any injection molding machine is possible.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
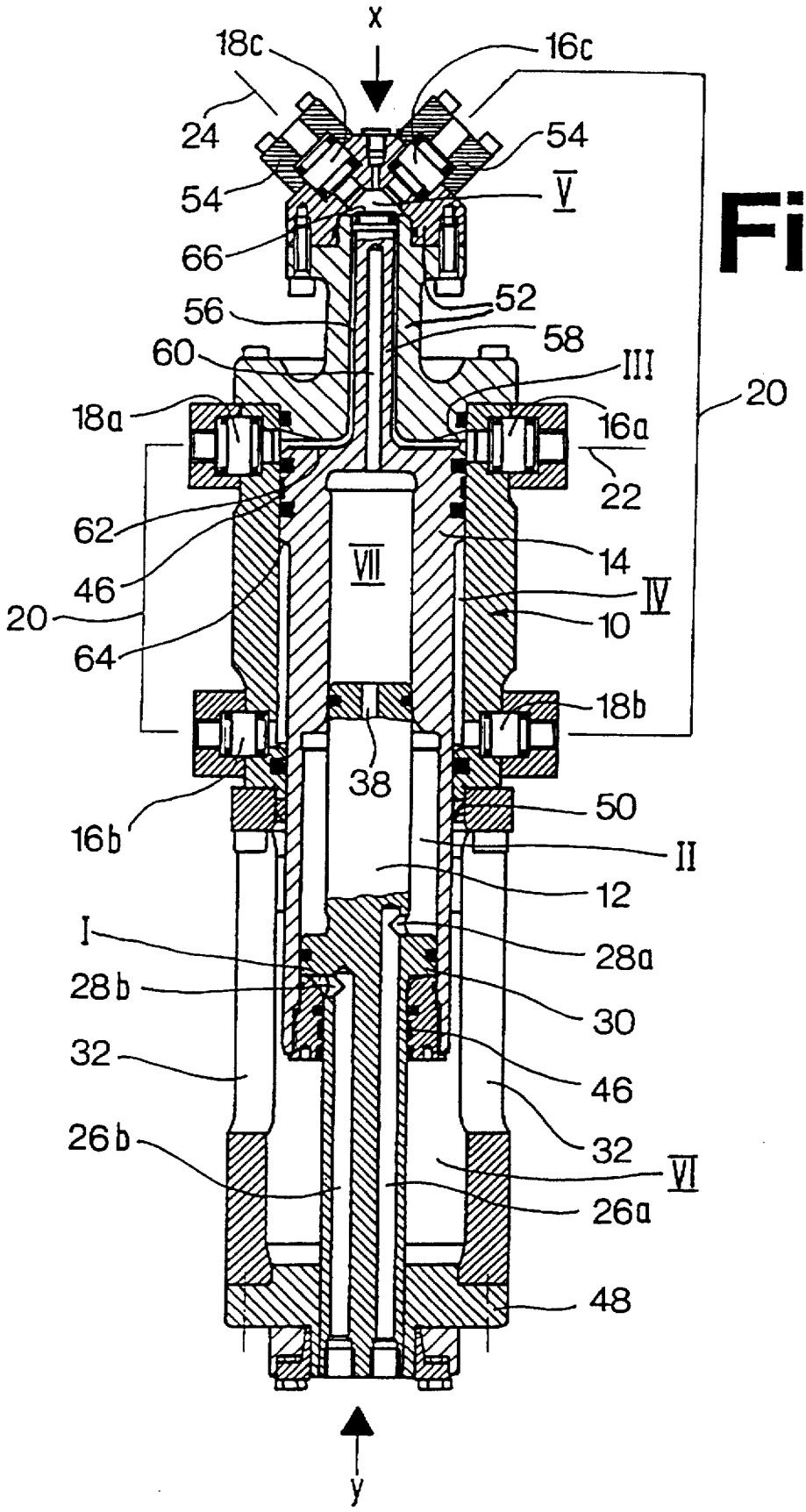
FIG. 1 is a front elevational view in section of a gas compressor according to the present invention.

The hydraulic gas compressor device illustrated in FIG. 1 comprises a housing 10 including several sections. A separating element 12 is within the bottom half of the device and within the housing 10. A reciprocating piston 14 is guided along the separating element 12. The piston passes or moves between two dead center positions or end positions during a three-stage compression cycle and forms the boundaries of three separate gas chambers III, IV and V with the housing 10 arranged in line behind each other. These chambers accommodate the gas to be compressed, which gas is preferably nitrogen gas.

For arrangement in series, separate gas chambers III, IV and V include three inlet valves 16*a, b* and *c* and three outlet valves 18*a, b* and *c*. One valve pair 16*a*, 18*a* is part of the first inlet and/or compression stage. A second valve pair 16*b*, 18*b* is part of the second inlet and/or compression stage. A third valve pair 16*c*, 18*c* is part of the third inlet and/or compression stage of the compressor. As shown specifically and graphically in FIG. 1, each inlet valve 16*b* or 16*c* is connected through a link line 20 to its corresponding outlet valve 18*a* or 18*b* of the previous gas chamber III or IV. In addition to the two link lines 20, and inlet line 22 connected to inlet valve 16*a* is available for low pressure gas. An outlet line 24 connected to outlet valve 18*c* is arranged to convey highly compressed gas from the compressor for further use.

The separating element 12 includes two separate feed lines 26 a and b for fluid, i.e., hydraulic oil, to drive the piston 14. Each line ends with one side 28*a* and *b* in a fluid and/or oil chamber I and II, respectively, of variable volume. Chambers I and II are separated from one another by a seal 30 and have boundaries formed by the piston 14 and the separating element 12. The seal 30 is formed by a separating bead extending axially and circumferentially around the external periphery of the separating element. A conventional sealing ring is in the seal separating bead.

Figure 6:
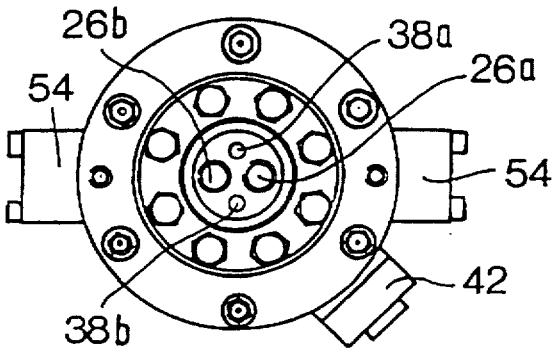
FIG. 6 is a bottom plan view of the compressor viewed in the direction of arrow Y of FIG. 1.

A pressure-reducing cavity VI, arranged adjacent the bottom end of the compressor, is defined by the separating element 12, the piston 14 and the housing 10. This pressure-reducing cavity VI is maintained at ambient pressure by its connection to the atmosphere through three lateral recesses 32, as shown more specifically in FIG. 7. The recesses are defined by four longitudinal webs 34 of housing 10. Although recesses 32 are covered by shelltype housing segments 36 which are rigidly connected to the longitudinal webs 34, the cover formed by segments 36 is not pressure-tight, providing ambient pressure in the pressure-reducing cavity VI. Another special pressure-reducing cavity VII is formed by the interior of the piston 14 and is connected by the pressure reducing channel 38 through separating element 12 to the atmosphere, ensuring that ambient pressure is also present in the pressure-reducing cavity VII. As shown specifically in FIG. 6, pressure-reducing channel 38 can be divided into two channel sections 38*a* and 38*b* at its end directed towards the atmosphere.

As shown in FIGS. 2 to 4 and 7, reciprocating piston 14 includes a locking device 40. Locking device 40 comprises a pointer device 42 indicating the position of piston 14. A change-over device (now shown) is connected to two limit switches 44 arranged in opposite directions along the stroke direction path of piston 14, for changing the stroke direction of piston 14 on its two dead center or end positions.

Figure 2:
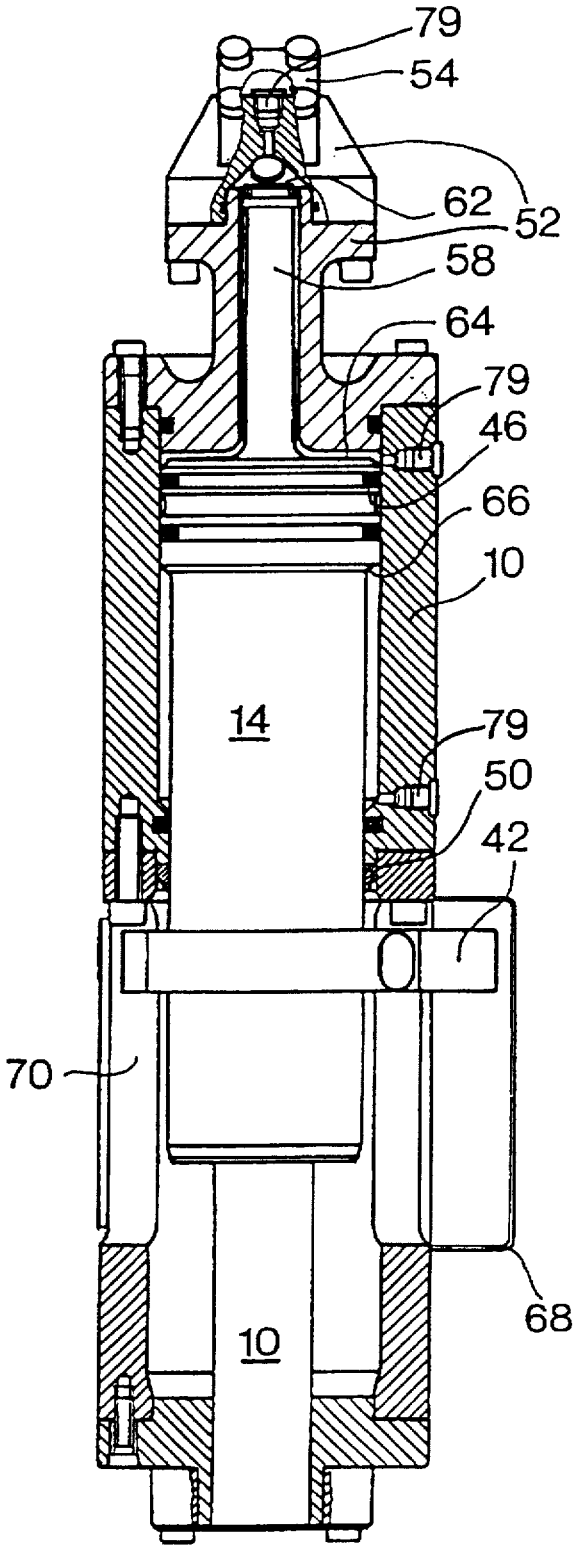
FIG. 2 is a side elevational view in section of the compressor, viewed at an angle of 90 degrees from the illustration of FIG. 1.
Figure 3:
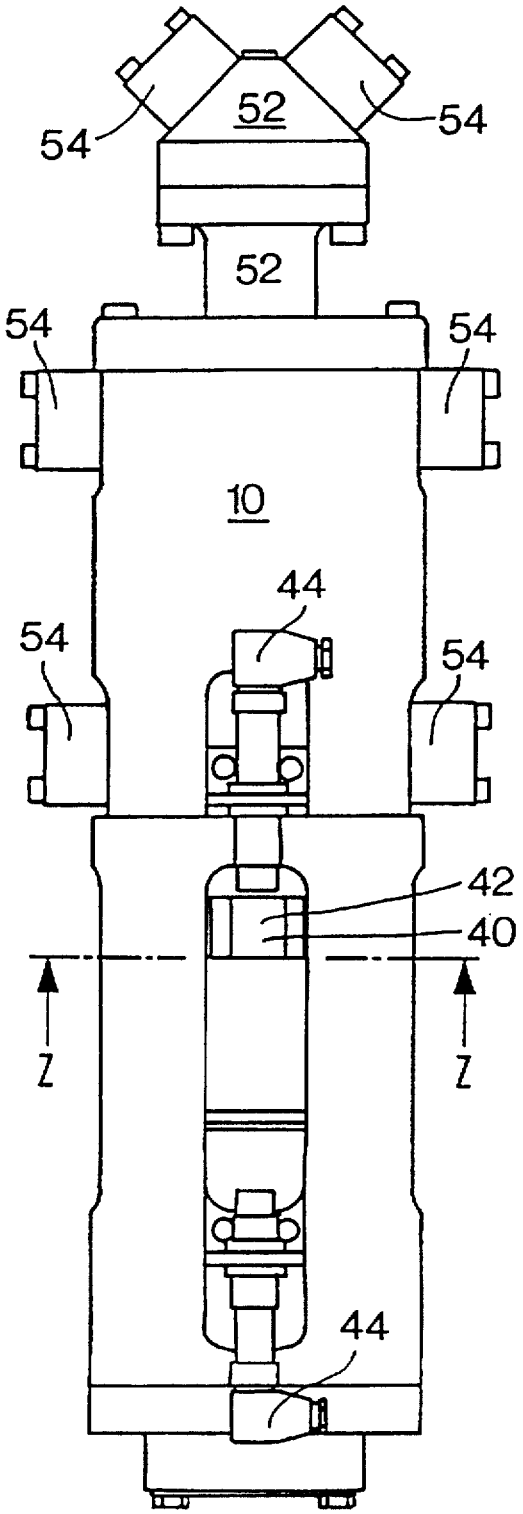
FIG. 3 is a front elevational view of the compressor of FIG. 1.
Figure 4:
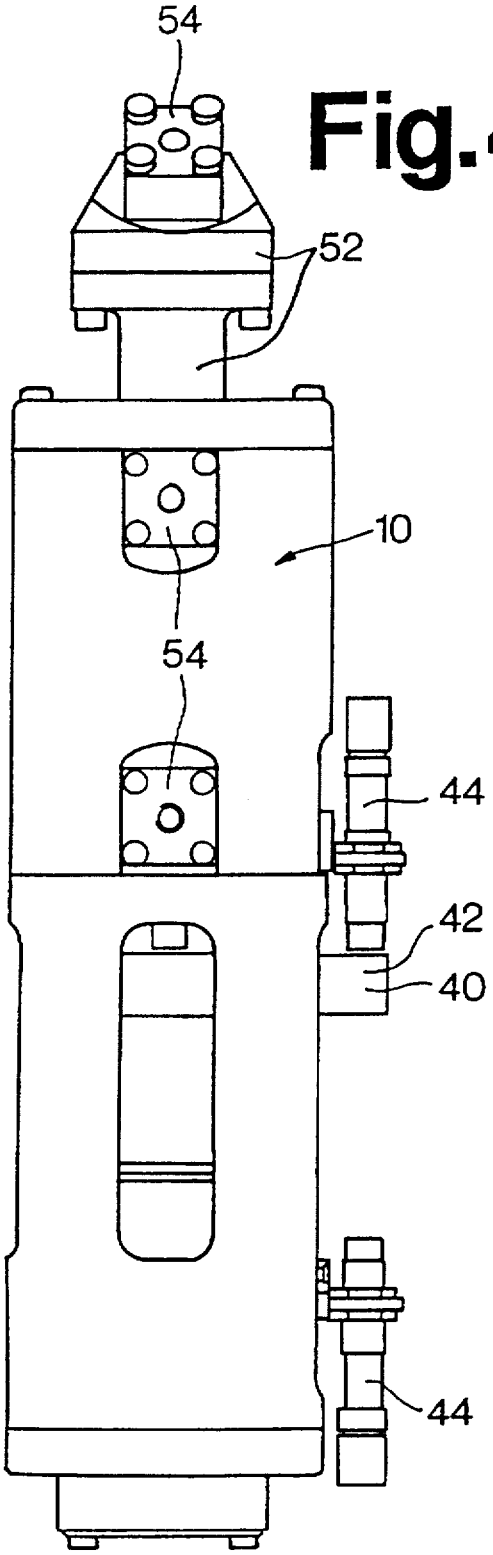
FIG. 4 is a side elevational view of the compressor of FIG. 2.
Figure 5:
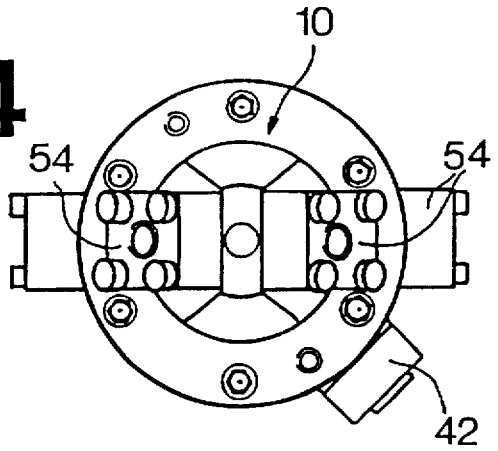
FIG. 5 is a top plan view of the compressor viewed in the direction of arrow X of FIG. 1.

As specifically shown in FIGS. 1 and 2, individual chambers I to VII of the compressor are each separated by conventional sliding seals which are not described herein in detail. To prevent jamming or tipping, the piston 14, being the only component of the device with any large stroke, is guided by guide tapes 46 in two places. The guide tapes are arranged at a fair distance from each other. In this manner, one guide mechanism for the piston 14 is arranged between chambers III and IV against the housing 10. A second guide mechanism for piston 14 is arranged along the external cylindrical periphery or surface of separating element 12. A third or central guide mechanism exists between seal 30 on separating element 12 and the internal periphery or surface of the piston 14 formed by chambers I and II. In manufacture, two tolerances are of particular importance to achieve the quality of the guide mechanism, i.e. the concentricity between the stroke area of the piston 14 and oil pressure chamber II and the alignment of the longitudinal axis of the housing relative to the longitudinal axis of the separating element 12. This alignment can be accurately set due to the rigid installation of separating element 12 by an end cap 48, by means of a so-called "Stuwe friction connection" (shrink-fit disc HSD 50), designated 50.

Opposite end cap 48 forming the foot or bottom section of the housing 10, the housing comprises a head or top section 52 which supports the brackets 54 holding the non-return valves 16*c* and 18*c*. The brackets 54 for the non-return valves are standardized or conventional components used for all non-return valves 16, 18, as shown in particular in FIG. 3. The head section 52 includes a central bore 56 receiving a cylindrical extension 58 of the piston 14, which extension includes a centrally arranged pocket 60. The length of the extension 58 enables extension 58 to be received (partially received) in the cylinder or central bore 56 when the piston is in its bottom position.

The first effective piston surface area 62 is formed by the top face of the piston 14 shown in FIG. 1. Surface area 62 is limited laterally outwardly by the external periphery of the piston 14 within the area of the guide tapes 46 and laterally inwardly by the external periphery of the cylindrical extension 58. The second effective piston surface area 64 is arranged below the top guide tape 46 as a step in the piston 14, limited radially outwardly by the external periphery of the piston 14 and the internal periphery of the housing 10 within the area of the chamber IV. The third piston surface area 66 is formed by the tip of the extension 58 and radially outwardly limited by the external periphery of the extension 58. The piston areas 62, 64, 66 of the piston 14, operating in each gas chamber, III, IV, and V, respectively, during compression at increasing pressures, are smaller than the piston area in each preceding pressure stage. The first piston area 62 is therefore larger than the second piston area 64, and the second piston area is larger than the third piston area 66.

The section of the housing 10 enclosing gas chambers III and IV and including the pair of brackets 54 at each end of the section accommodating valves 16*a*, 18*a*, 16*b* and 18*b*, is sealed pressure-tight against the atmosphere at its end by appropriate seals. This is not the case, as described above, for the bottom section of the housing shown in FIG. 1 including the lateral recesses 32. A coolant (not shown) can be fed through the pressure release channel 38 of the separating element 12 to the interior reduced-pressure cavity VII of the piston 14 and possibly to another reduced-pressure cavity VI. Owing to the reduced-pressure cavities VI and VII, the oil and gas sides of the compressor are safely separated. At the same time a minimum movement mass is reached for the piston 14 by the chamber VII, in which problems, otherwise occurring due to high inertias of the masses moved, as known from previous processes, are eliminated. The coolant can be directly effective at the pressurized inside of the piston 14, which is subject to the highest temperatures, by introducing a coolant through the pressure-reducing bore 38. To achieve a maximum efficiency of the compressor, the compression ratios, the cavity and the efficiencies of individual stages are designed accordingly.

As shown specifically in FIG. 2, pointer device 42, which moves when the compressor is in operation, is covered by a transparent cap 68. Cap 68 is rigidly connected to the external periphery of the housing 10.

When changing pressurization and during pressure release through the feed lines 26*a* and *b*, the fluid chambers II and/or I are alternatively filled with hydraulic oil and/or oil is discharged, axially reciprocating the piston 14. The axial reciprocation of piston 14 brings the pointer device of the locking device 40 alternatively close to or into contact with the top and bottom limit switches 44 in both dead center positions of the piston 14. Contact with one of the limit switches will then trigger, due to being part of the change-over device (not shown), the reversal of the hydraulic oil feed and/or discharge to and from the fluid chambers I, II.

Figure 7:
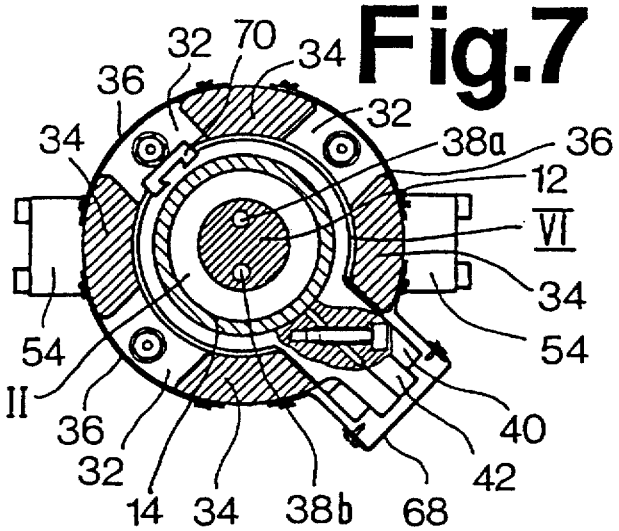
FIG. 7 is a bottom plan view in section taken along line z—z of FIG. 3.

As shown specifically in FIG. 7, the pointer device 42 has two hollow-type neck sections. The sections are clamped to the external periphery of the piston by a fastening device and a dovetail lock. The piston is guided by the pointer device 42 which is in turn guided in one of the four longitudinal recesses 32 by two PTFE discs. This guiding will securely prevent radial movement of the piston.

Figure 9:
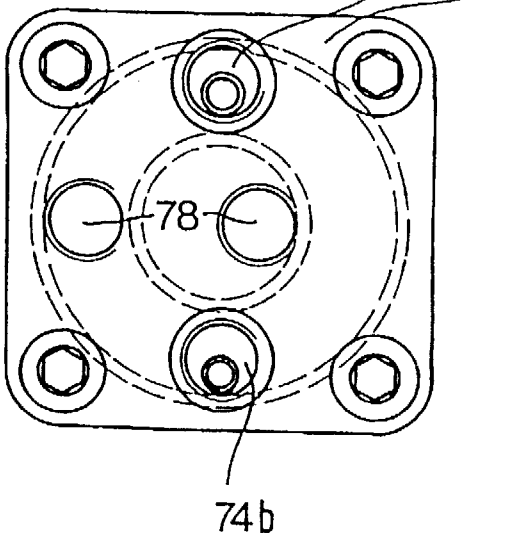
FIG. 9 is an end elevational view of the heat exchanger of FIG. 8 viewed in the direction of arrow w in FIG. 8.
Figure 8:
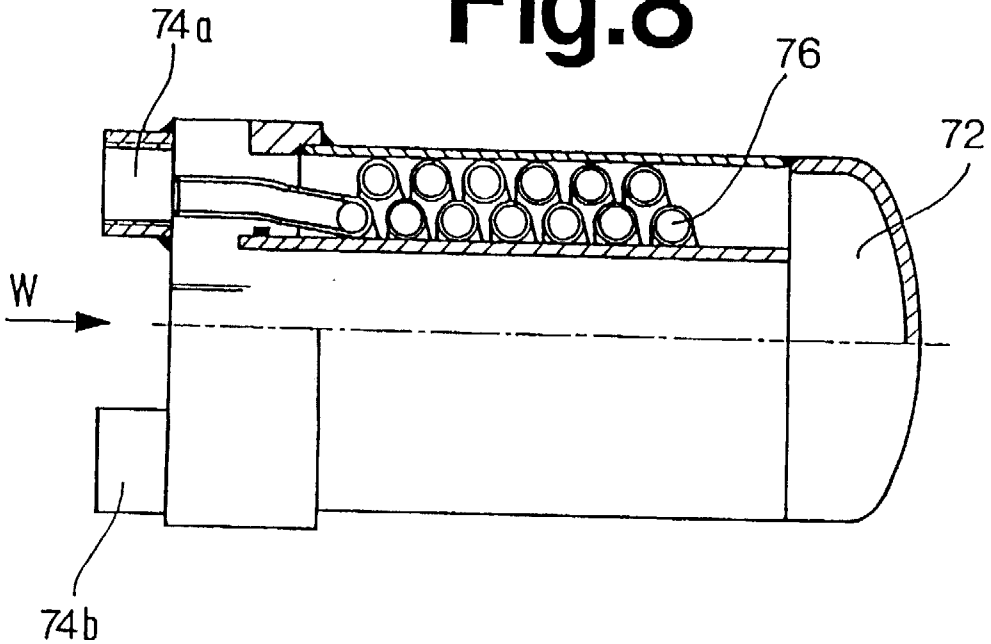
FIG. 8 is a side elevational view, partially in section, of a heat exchange for use with the compressor of the present invention.

One heat exchanger 73 each may be included in the link lines 20 servicing as a cooler and dissipating existing heat generated during compression from the gas. The heat exchanger, as shown in FIGS. 8 and 9, includes connecting points 74*a* and *b* to be connected to the appropriate link line 20, servicing as a gas inlet and/or outlet into and/or out of the heat exchanger 72. As shown specifically in FIG. 8, gas is passed through the heat exchanger 72 through and within a coil 76 and is cooled by water of the counterflow system, admitted into and discharged from the heat exchanger 72 through connections 78. Suitable heat exchangers are sufficiently known to the professional, and thus, are not described in detail. Gas cooled by the heat exchanger 72 is again made available to the compressor for further compression through the appropriate link line 20. Measuring points 79 (FIG. 2) are arranged in the head section 52 and the central section of the housing 10 of the separate cavities III, IV for connection of pressure gauges to monitor the device. Such gauges may also be connected to any other point of the device, if required.

The operation of the device according to the present invention is described in connection with FIG. 10 to 12 where the device is only graphically illustrated for better presentation and clarity. The description of its principles of operation, however, also applies to the compressor shown in FIGS. 1 to 9. FIG. 12 separates the volume and pressure ratios for chambers I to V, with ratios shown on the left-hand side of FIG. 12 between vertical dotted lines representing change-over of the piston 14 from its bottom dead center position shown in FIG. 11 to its top dead center position shown in FIG. 10. The graphs on the right-hand side of FIG. 12 up to the next vertical dotted line show the change-over procedure based on movement from the position illustrated in FIG. 10 to that illustrated in FIG. 11. The entire illustration of FIG. 12 between the two outer vertical dotted lines arranged away from each other therefore describes the stroke of the piston 10 between two subsequent dead center positions, thus forming a threestage compression cycle. After completion of this cycle, a new cycle will commence, which is constructively expressed on the right-hand side of FIG. 12 at the margin.

Figure 10:
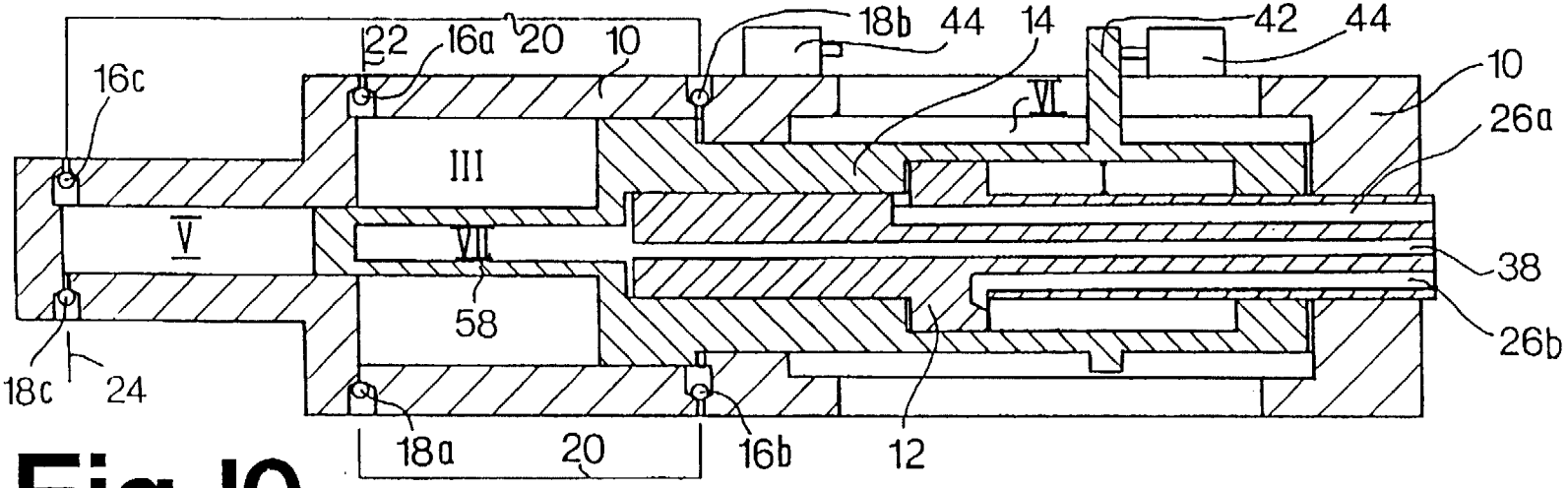
FIGS. 10 and 11 are side elevational, graphical views in section illustrating the principle of the compressor according to the present invention, with the piston in its two dead center positions, respectively.
Figure 11:
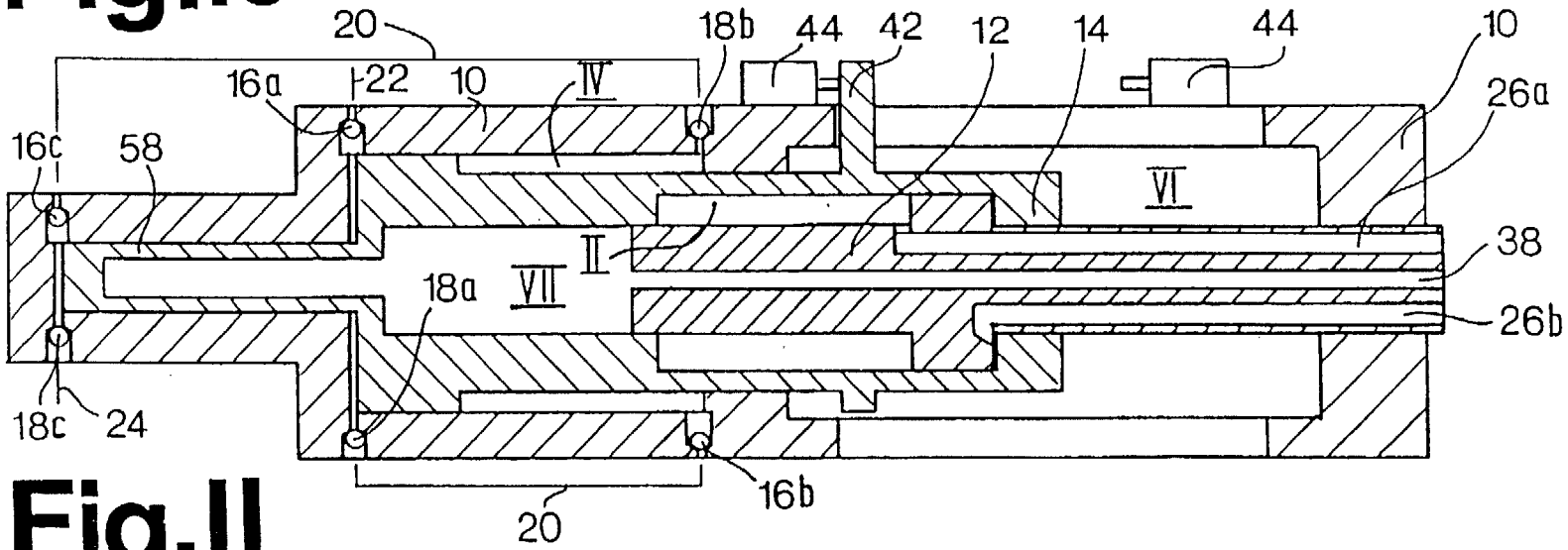
Figure 12:
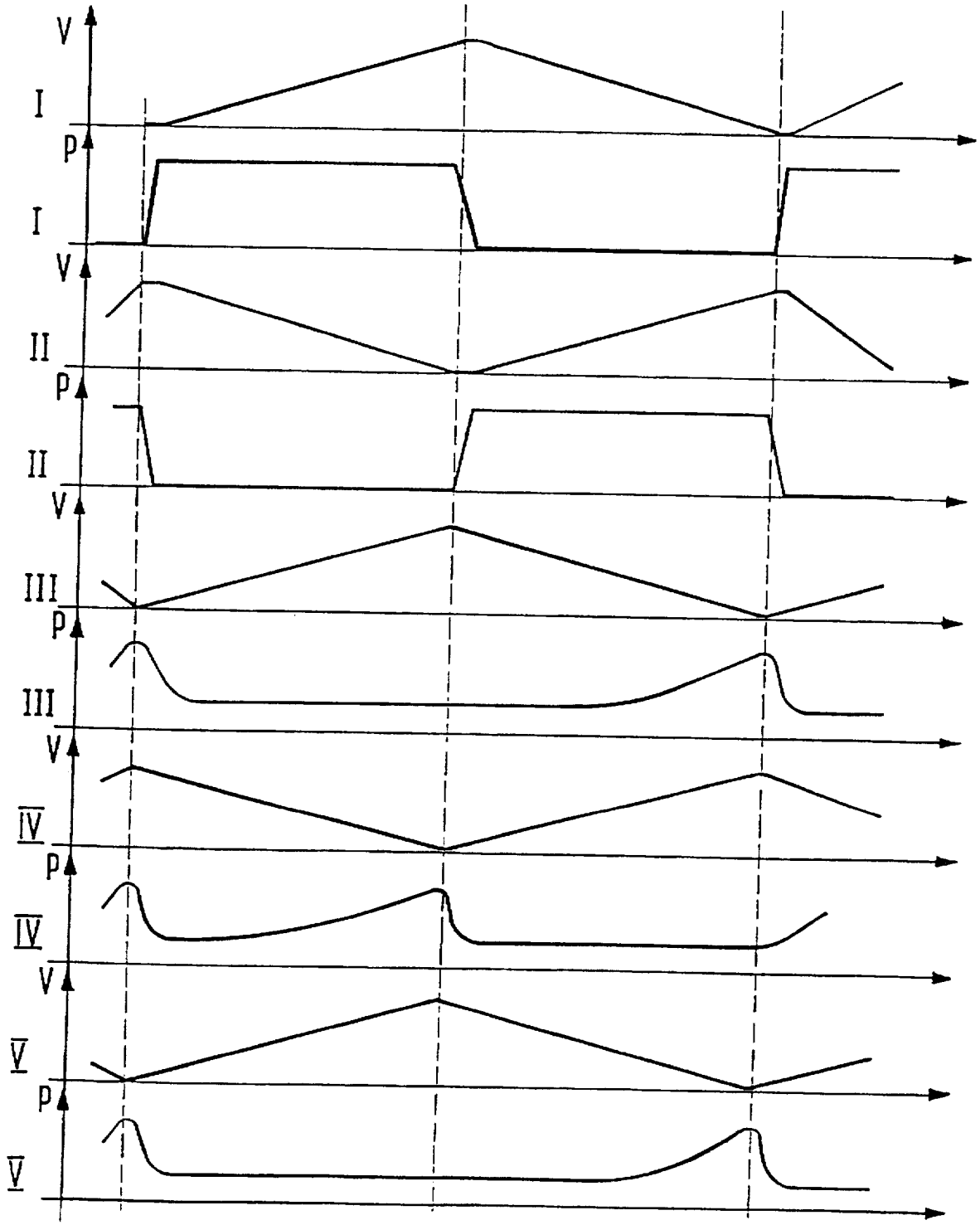
FIG. 12 illustrates volume diagrams and pressure diagrams versus time as occurring in chambers I to V of the compressor of FIG. 1.

The fluid chamber I is filled with hydraulic oil by pressurization through the feed line 26*b*, causing the piston 14 to travel from its left-hand dead center or end position shown in FIG. 11 to its right-hand position shown in FIG. 10. The pressure cycles in the fluid chamber I connected to this travel are shown in FIG. 12. During travel of the piston 14 into its right-hand end position, gas, for instance nitrogen gas, will enter through the inlet line 22 and the non-return valve 16*a*, from a tank at a pressure of 5 bar into the low-pressure chamber III.

During this stroke of the piston 14, the volume and the pressure in the fluid chamber II will be reduced to zero and the fluid within the chamber II is discharged through the feed line 26*a*. Furthermore, the gas in the medium-pressure chamber IV is passed through the outlet valve 18*b* and the inlet valve 16*c* into the high-pressure chamber V. This operation results in a compression cycle in chamber IV shown on the left-hand side of FIG. 12 and gas entering into chamber V. During subsequent change-over by the limit switches 44 of the change-over device, the piston 14 will travel from its position shown in FIG. 10 to return to its former top dead-center position illustrated in FIG. 11. This return stroke is achieved by fluid being pumped into the chamber II through the feed line 26*a*, while the chamber I is depressurized by the feed line 26*b*.

During this return stroke of the piston, the gas in the chamber III is compressed and passed under pressure through the outlet valve 18*a*, the link line 20 and the inlet valve 16*b* into the medium-pressure chamber IV. This inlet cycle for the chamber IV is illustrated on the right-hand side of FIG. 12. In addition, a compression cycle occurs in the high-pressure chamber V, with the compressed gas volume being discharged through the outlet valve 18*c* and the line 24 from the compressor during the second phase after change-over to the required final pressure. The discharged gas may then without difficulty be recompressed to a level of 400 bar.

In addition to nitrogen gas, the compressor is also suitable for the compression of air. After completion of the three-stage compression and the inlet cycle, another cycle, as described above, will commence, i.e., the piston 14 will travel again from its position shown in FIG. 11 to its position shown in FIG. 10. Due to the cavities VI and VII being preferably depressurized, i.e., having constant pressures, their pressure cycle is not included in the illustration of FIG. 12. Opposing non-return valves (not shown) may be used in the feed lines 38*a*, *b*, to improve change-over.

Figure 13:
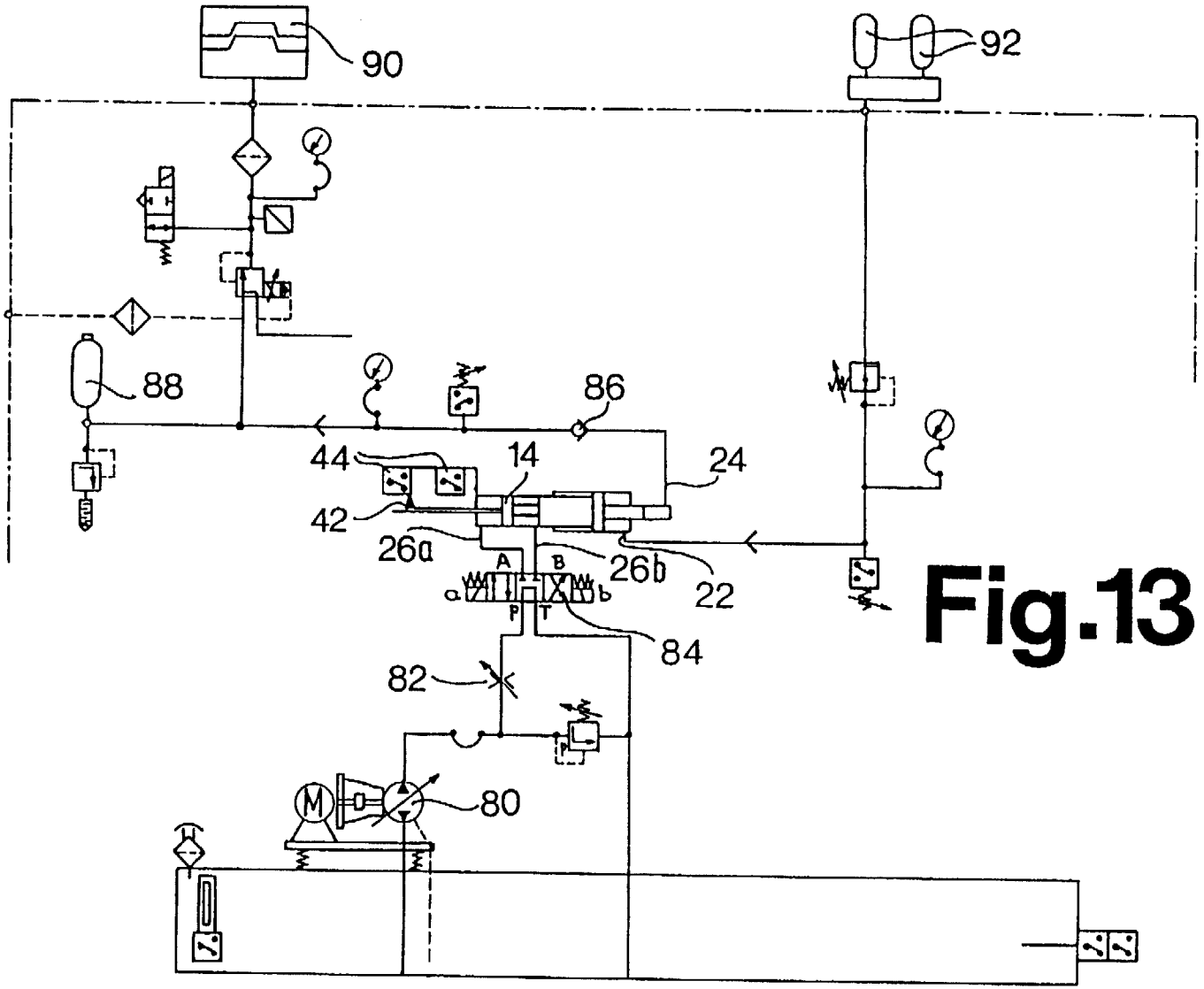
FIG. 13 is a graphical illustration of an internal gas pressure device using the compressor according to the present invention.

Referring to FIG. 13, the use of the device of FIGS. 1 to 12 as part of an internal gas pressure device is described. The conventional parts of the internal gas pressure device are only described, as necessary, to explain the present invention. Gas discharge of the compressor is infinitely variable by controlling the fluid volume to be fed to the fluid chambers I, II. For this purpose, an infinitely variable hydraulic pump 80 and/or an adjustable pressure-reducing valve 82 may be employed. The final pressure on the gas side of the compressor will depend only on the inlet pressure and the ratio for the compression chambers III to V, with the final pressure being controlled by the inlet pressure. The change-over of fluid chamber I to fluid chamber II is controlled by a 4/3-way valve 84 which can be controlled by the limit switches 44 of the change-over device (now shown).

The gas volumes compressed to high pressure are transferred to an accumulator 88 (for instance to a hydraulic accumulator) through link line 24, secured by a conventional non-return valve 86. The gas will be stored in the accumulator. Any gas volumes required for the mold 90 of an injection molding process can be selected. The internal gas pressure device illustrated in FIG. 13 facilitates continuous gas supplies to an injection mold by a hydraulic accumulator 88, with the compressor being supplied with gas by the feed line 22 from nitrogen bottles 92 for charging the chamber III.

Due to the small dimensions of the compressor of the invention and low-cost manufacture, it may be used to special advantage for any type of internal gas pressure device.

While a particular embodiment has been chosen to illustrate the invention, it will be understood by those skilled in the art that various changes and modifications can be made therein without departing from the scope of the invention as defined in the appended claims.

I claim:

1. A gas compressor, comprising:

a housing;

a separating element stationarily mounted in and relative to said housing;

a piston mounted for movement guided along said separating element between first and second dead center positions;

drive means for moving said piston along said separating element between said dead center positions, said drive means including first and second fluid chambers of variable volume and including first and second feed lines in said separating element coupled to said first and second fluid chambers, respectively, said first and second fluid chambers being separated by a seal and being bounded by said separating element and said piston;

first, second and third separate gas chambers within said housing about said piston; and conduit means for connecting said first, second and third gas chambers in series;

whereby, gas can be compressed in said gas chambers by said piston in a three-stage compression cycle.

2. A gas compressor according to claim 1 wherein said first, second and third gas chambers comprise first, second and third inlet valves, respectively, and first, second and third outlet valves, respectively; and said conduit means comprises a first link line connecting said first outlet valve to said second inlet valve, and a second link line connecting said second outlet valve to said third inlet valve.

3. A gas compressor according to claim 1 wherein said piston comprises a first pressure reducing cavity inside said piston connected to atmosphere through a pressure reducing channel; and a second pressure reducing cavity is maintained at ambient pressure and is defined by said separating element, said piston and said housing.

4. A gas compressor according to claim 3 wherein means for feeding coolant through said pressure reducing channel into said first pressure reducing cavity and said second pressure reducing cavity is connected to said piston.

5. A gas compressor according to claim 1 wherein said piston comprises a locking means including a pointer for indicating positions of said piston and including limit switch means for sensing when said piston is located in the dead center positions and for changing directions of movement of said piston at the dead center positions.

6. A gas compressor according to claim 1 wherein said piston comprises first, second and third surface areas in said first, second and third gas chambers, respectively, said third surface area being smaller than said second surface area, said second surface area being smaller than said first surface area.

7. A gas compressor according to claim 1 wherein said conduit means comprises heat exchanger means.

8. A gas compressor according to claim 1 wherein control means is coupled to said first and second fluid chambers for supplying variable fluid volumes to said first and second fluid chambers;

whereby gas discharge is infinitely variable by regulating said control means.

9. A gas compressor according to claim 8 wherein said control means comprises a pump.

10. A gas compressor according to claim 8 wherein said control means comprises a pressure reducing valve.

11. A gas compressor according to claim 1 wherein said third gas chamber comprises an outlet connected to accumulator means for storing gas volumes compressed to high pressures; and said accumulator means is connected to a gas operated mold of an injection molding system.

12. A gas compressor, comprising:

a housing;

a separating element stationarily mounted in said housing;

a piston mounted for movement guided along said separating element between first and second dead center positions;

drive means for moving said piston along said separating element between said dead center positions, said drive means including first and second fluid chambers of variable volume and including first and second feed lines in said separating element coupled to said first and second fluid chambers, respectively, said first and second fluid chambers being separated by a seal and being bounded by said separating element and said piston;

a first pressure reducing cavity inside said piston connected to atmosphere through a pressure reducing channel;

a second pressure reducing cavity maintained at ambient pressure and defined by said separating element, said piston and said housing;

first, second and third separate gas chambers within said housing about said piston; and conduit means for connecting said first, second and third gas chambers in series; and whereby, gas can be compressed in said gas chambers by said piston in a three-stage compression cycle.

13. A gas compressor according to claim 12 wherein said first, second and third gas chambers comprise first, second and third inlet valves, respectively, and first, second and third outlet valves, respectively; and said conduit means comprises a first link line connecting said first outlet valve to said second inlet valve, and a second link line connecting said second outlet valve to said third inlet valve.

14. A gas compressor according to claim 12 wherein said piston comprises a locking means including a pointer for indicating positions of said piston and including limit switch means for sensing when said piston is located in the dead center positions and for changing directions of movement of said piston at the dead center positions.

15. A gas compressor according to claim 12 wherein said piston comprises first, second and third surface areas in said first, second and third gas chambers, respectively, said third surface area being smaller than said second surface area, said second surface area being smaller than said first surface area.

16. A gas compressor according to claim 12 wherein said conduit means comprises heat exchanger means.

17. A gas compressor according to claim 12 wherein means for feeding coolant through said pressure reducing channel into said first pressure reducing cavity and said second pressure reducing cavity is connected to said piston.

18. A gas compressor according to claim 12 wherein control means is coupled to said first and second fluid chambers for supplying variable fluid volumes to said first and second fluid chambers;

whereby gas discharge is infinitely variable by regulating said control means.

19. A gas compressor according to claim 18 wherein said control means comprises a pump.

20. A gas compressor according to claim 18 wherein said control means comprises a pressure reducing valve.

21. A gas compressor according to claim 12 wherein said third gas chamber comprises an outlet connected to accumulator means for storing gas volumes compressed to high pressures; and said accumulator means is connected to a gas operated mold of an injection molding system.

22. A gas compressor, comprising:

a housing;

a separating element stationarily mounted in said housing;

a piston mounted for movement guided along said separating element between first and second dead center positions, said piston having a locking means including a pointer for indicating positions of said piston and including limit switch means for sensing when said piston is located in the dead center positions and for changing directions of movement of said piston at the dead center positions;

drive means for moving said piston along said separating element between said dead center positions, said drive means including first and second fluid chambers of variable volume and including first and second feed lines in said separating element coupled to said first and second fluid chambers, respectively, said first and second fluid chambers being separated by a seal and being bounded by said separating element and said piston;

first, second and third separate gas chambers within said housing about said piston;

conduit means for connecting said first, second and third gas chambers in series; and whereby, gas can be compressed in said gas chambers by said piston in a three-stage compression cycle.

* * * * *